US005368113A

United States Patent [19]

Schulze-Beckinghausen

[11] Patent Number: 5,368,113

[45] Date of Patent: Nov. 29, 1994

[54] DEVICE FOR POSITIONING EQUIPMENT

[75] Inventor: Joerg E. Schulze-Beckinghausen, Garbsen, Germany

[73] Assignee: Weatherford/Lamb, Inc., Houston, Tex.

[21] Appl. No.: 139,410

[22] Filed: Oct. 19, 1993

[30] Foreign Application Priority Data

Oct. 21, 1992 [EP] European Pat. Off. ..... 92117969.3

[51] Int. Cl.[5] ..... E21B 7/00

[52] U.S. Cl. ..... 175/162

[58] Field of Search ..... 175/162, 122, 203, 220, 175/85

[56] References Cited

U.S. PATENT DOCUMENTS

| | | | |
|---|---|---|---|
| 3,883,009 | 5/1975 | Swoboda, Jr. et al. | 214/1 B |
| 4,077,525 | 3/1978 | Callegari et al. | 214/2.5 |
| 4,274,777 | 6/1981 | Scaggs | 414/22 |
| 4,629,014 | 12/1986 | Swisher et al. | 175/162 X |
| 4,735,270 | 4/1988 | Fenyvesi | 175/162 X |
| 4,971,162 | 11/1990 | Back | 175/162 X |

OTHER PUBLICATIONS

"Rigid Pushing Chains," Serapid USA, Inc., 1992.

*Primary Examiner*—Michael Powell Buiz
*Attorney, Agent, or Firm*—Guy McClung

[57] ABSTRACT

A device (1) for position a tong comprises a flexible chain (2) provided with compression members (7) and a flexible locking chain (3). When a hydraulic motor (14) is rotated anti-clockwise the chains (2,3) are brought into operative engagement to form a rigid member (4) which is secured to a ball (29) on the drilling derrick. A tong is suspended from the device (1) which, in turn, is suspended from a cable (27) secured high in the derrick. The tong can be advanced or withdrawn towards a pipe string by rotating the motor (14) anti-clockwise or clockwise to extend or dismantle the rigid member (4) as desired.

7 Claims, 5 Drawing Sheets

DEVICE FOR POSITIONING EQUIPMENT

FIELD OF THE INVENTION

This invention relates to a device for positioning equipment and, more particularly but not exclusively, is concerned with a device for positioning tongs in the construction of oil and gas wells. The invention also relates to a drilling rig provided with such a device.

1. Background of the Invention

Tongs are used in the construction of oil and gas wells to connect and disconnect threaded tubulars, for example drill pipe and casing. Typically, such tongs are suspended from a point high in the derrick by a cable and are manoeuvred manually into and out of position circumjacent a pipe string.

When handling large diameter tubulars very heavy tongs are necessary and these are particularly difficult to manhandle. Furthermore, it is highly desirable to keep the area circumjacent the drill string as clear as possible. Until now the only practical solution to the problem has been to use very strong, highly experienced staff to effect the required manoeuvres.

2. Summary of the Invention

According to the present invention there is provided a device for positioning equipment which device comprises a first member and a second member each of which is flexible but which can co-operate to form a rigid member.

Preferably said first member comprises a chain having a plurality of compression members. If desired such compression members may form one side of said chain or may be disposed between two adjacent chains.

Advantageously, each compression member comprises a base portion, an inclined portion and a blocking portion, and wherein the inclined portions of adjacent compression members are inclined in opposite directions so that said blocking portions lie in substantially the same plane.

Preferably, each compression member is provided with a recess for accommodating a pin of a locking chain.

Advantageously, said recess is shaped to inhibit removal of said pin when said block portions are disposed closely adjacent one another, i.e., when cooperating to form a rigid member.

Preferably, said second member comprises a locking chain.

Advantageously, said device includes means to guide said first member and said second member into operative juxtaposition. Such means may comprise, for example a guide and a surface, for example the surface of a roller or a resilient surface.

Preferably, said device includes a motor to extend and collapse said rigid member. Such motor may be, for example an electric motor although a hydraulic motor may be preferably in the oil and gas industry.

Advantageously, said motor is arranged to act on said first member. It could however also act on said second member or on both said first member and second member simultaneously if desired.

Preferably, said motor is provided with a drive sprocket arranged to act on said first member.

Advantageously, said device is provided with a channel section for guiding an initial length of said rigid member.

Preferably, said device includes a housing, one end of said first member and said second member is secured to said housing, and said device is adapted to be suspended from a cable and to support a tong.

Advantageously, means are also provided to adjust the height of said tong. Such means may conveniently be placed in the cable or between the device and the tong and may conveniently comprise a hydraulic piston and cylinder assembly.

The present invention also provides a drilling rig comprising a derrick, a device in accordance with the present invention suspended from said derrick, and a tong supported by said device.

For a better understanding of the present invention reference will now be made, by way of example, to the accompanying drawings, in which:

DETAILED DESCRIPTION OF THE PREFERRED EMBODIMENT

Figure 1:
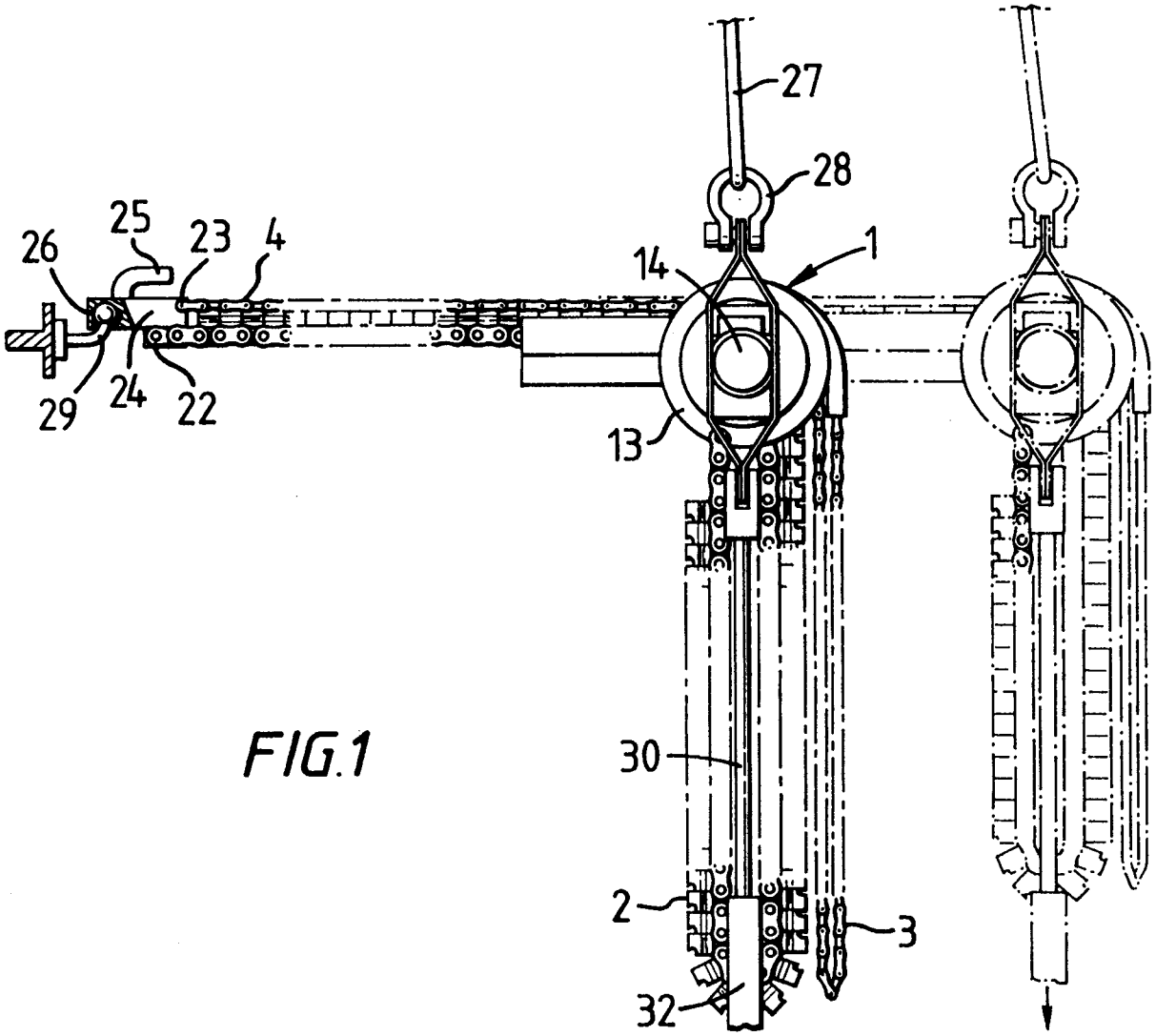
FIG. 1 is a side view of a device in accordance with the present invention in two different positions, one shown in full lines and the other shown in chain dotted lines.

Referring to FIG. 1 of the drawings, there is shown a positioning device which is generally identified by reference numeral 1.

The device 1 comprises a first member 2 and a second member 3. The first member 2 and the second member 3 are each flexible but co-operate to form a rigid member 4.

Figure 4:
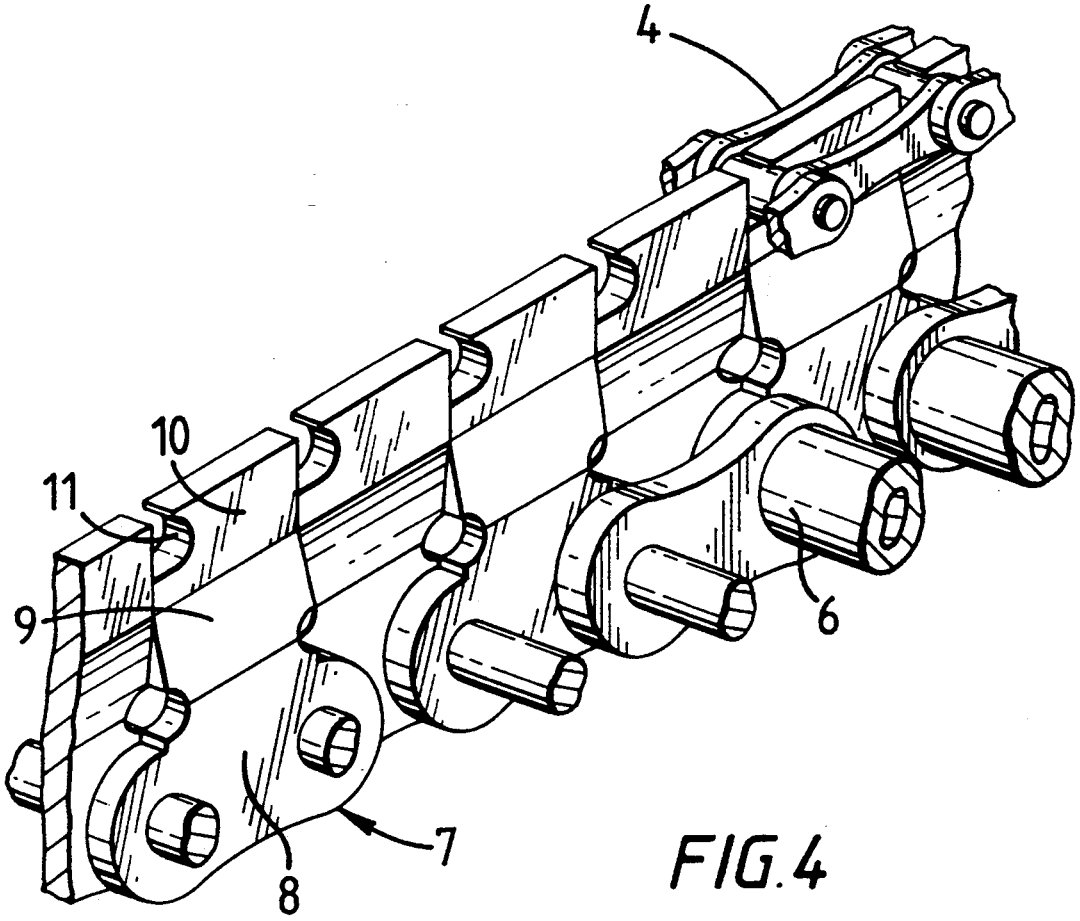
FIG. 4 is a perspective view, with parts cut away, of another part of the device.

The member 2 comprises two parallel chains 5,6 between which are mounted a succession of compression members 7. As shown in FIG. 4 each compression member 7 comprises a base portion 8, an inclined portion 9 and a blocking portion 10 having a recess 11.

The inclined portions 9 of adjacent compression members 7 are alternately inclined so that the blocking portions 10 lie in a common plane.

The second member 3 comprises a locking chain, one end 12 of which is suspended from a housing 13 on which is mounted a hydraulic motor 14 having a drive sprocket 15 with two rows of teeth 16,17.

Figure 2:
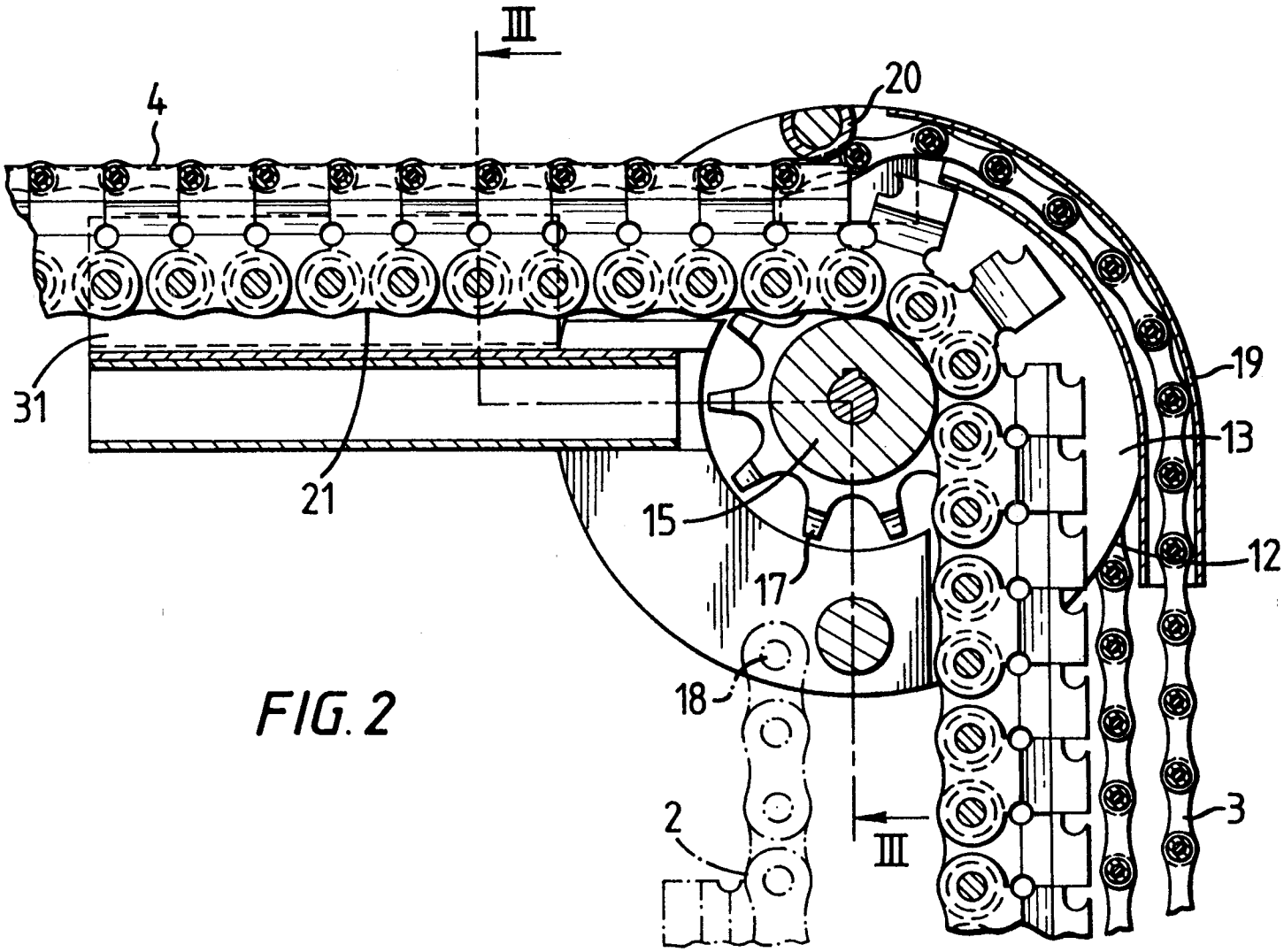
FIG. 2 is a side view, with parts cut away, of part of the device shown in FIG. 1.
Figure 3:
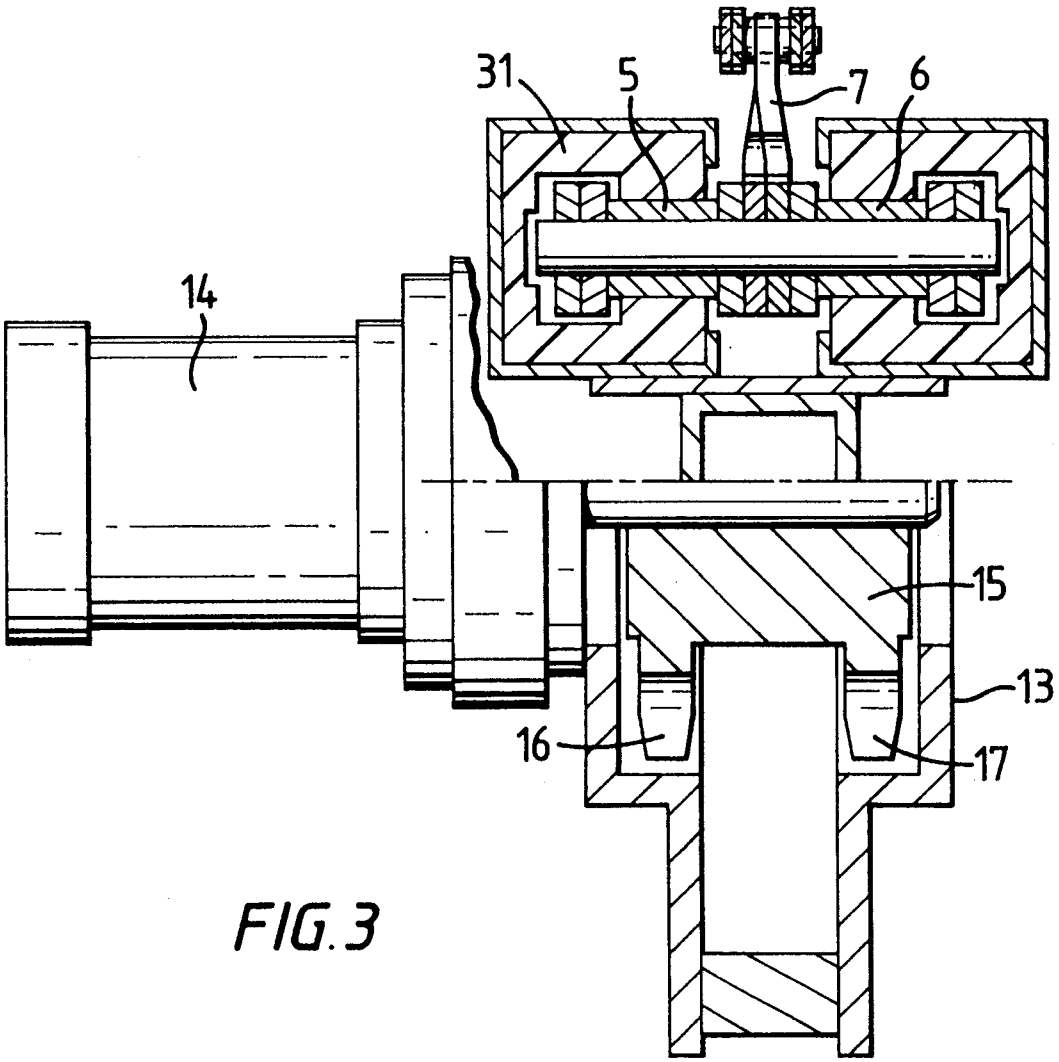
FIG. 3 is a view taken on line III—III of FIG. 2 with parts cut away for clarity.

One end 18 of the first member 2 is also secured to the housing 13 as shown in FIG. 2.

Both the first member 2 and the second member 3 extend downwardly from the housing 13 and then upwardly. The first member 2 passes over the drive sprocket 15 whilst the second member 3 passes through a guide tube 19 which opens adjacent a resilient insertion member 20.

In use, if the hydraulic motor 14 is rotated anti-clockwise as shown in FIG. 2 the upper reach 21 of the first member 2 moves to the left relative to plate 13. At the same time, the pins of the locking chain forming the second member 3 move into the recesses 11. This cooperation forms a rigid member 4. In particular, the locking chain prevents the blocking portions 10 separating to any appreciable extent. Furthermore, the recesses 11 are shaped to inhibit accidental separation of the locking chain.

When the hydraulic motor 14 is rotated clockwise as viewed in FIG. 2 the first member 2 and the second member 3 are separated as they pass between insertion member 20 and the guide tube 19.

The opposite ends 22, 23 of the first member 2 and the second member 3 respectively are attached to a mounting piece 24 having a handle 25 and a socket 26.

Figure 5:
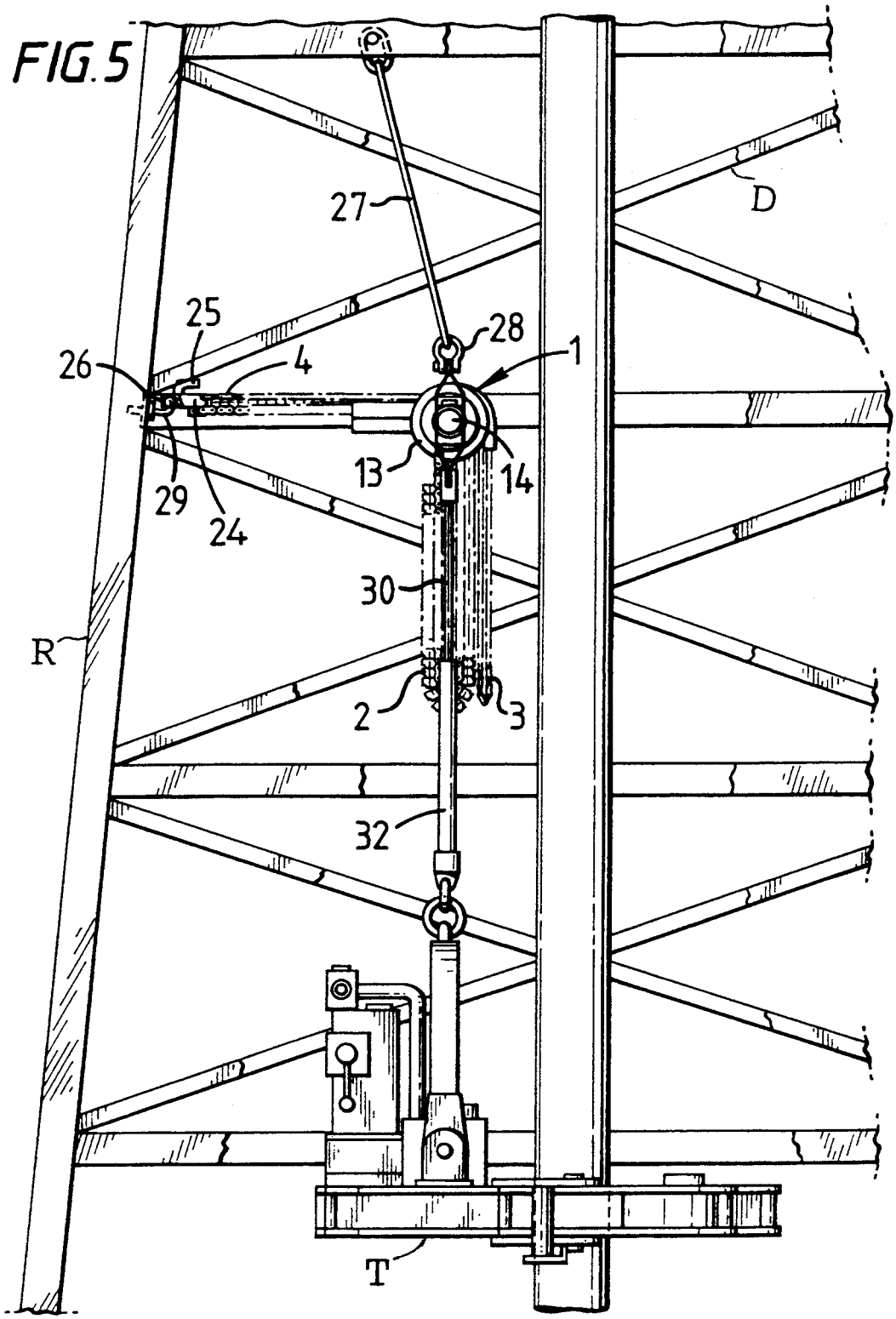
FIG. 5 is a side view of a device according to the present invention on a drilling rig.

In use, as shown in FIG. 5, the device I is first suspended from a point high in a drilling derrick D of a drilling rig R by means of a cable 27 and a shackle 28. The mounting piece 24 is then lifted onto a ball 29 screwed to the drilling derrick D. The hydraulic motor 14 is then rotated to produce a rigid member 4 of the required extension. A tong T is then suspended from the plate 73 by means of support rod 30 and hydraulic cylinder 32.

When it is desired to move the tong into engagement with a pipe to be rotated the hydraulic motor 14 is rotated anti-clockwise thereby moving the device 1 to the position shown in chain dotted lines in FIG. 1. The height of the tong can be adjusted via hydraulic cylinder 32.

When the tong has completed its tightening/releasing duty the hydraulic motor 14 is rotated clockwise to withdraw the tong to its initial position. If desired, the hydraulic motor 14 can be rotated clockwise until the device 1 is adjacent the mounting piece 24.

The housing 13 is also provided with a guide section 31 for guiding an initial length of the rigid member 4. The guide section 31 supports the rigid member 4 and inhibits it twisting relative to the drive sprocket 15 and damaging the teeth thereof.

I claim:

1. A device for positioning equipment, which device comprises a first member and a second member each of which is flexible but which can co-operate to form a rigid meanbet, wherein said first member comprises a chain having a plurality of compression members, wherein each compression member comprises a base portion, an inclined portion and a blocking portion, and wherein the inclined portions of adjacent compression member are inclined in opposite directions so that said blocking portions lie in substantially the same plane, wherein each compression member is provided with a recess for accommodating a pin of a locking chain, wherein said recess is shaped to inhibit removal of said pin when said blocking portions are disposed closely adjacent one another, wherein said second member comprises a locking chain, wherein said device includes means to guide said first member and said second member into operative juxtaposition, and a motor to extend and collapse said rigid member.

2. A device as claimed in claim 1, wherein said motor is arranged to act on said first member.

3. A device as claimed in claim 2, wherein said motor is provided with a drive sprocket arranged to act on said first member.

4. A device as claimed in claim 1, including a guide section for guiding an initial length of said rigid member.

5. A device as claimed in claim 1, including a housing, wherein one end of said first member and said second member is secured to said housing and wherein said device is adapted to be suspended from a cable and to support a tong.

6. A device as claimed in claim 5, including means to adjust the height of said tong.

7. A drilling rig comprising a derrick, a device for positioning a tong suspended from said derrick, and a tong supported from said device, wherein said device comprises a first member and a second member each of which is flexible but which can co-operate to form a rigid member, wherein said first member comprises a chain having a plurality of compression members, wherein each compression member comprises a base portion, an inclined portion and a blocking portion, and wherein the inclined portions of adjacent compression member are inclined in opposite directions so that said blocking portions lie in substantially the same plane, wherein each compression member is provided with a recess for accommodating a pin of a locking chain, wherein said recess is shaped to inhibit removal of said pin when said blocking portions are disposed closely adjacent one another, wherein said second member comprises a locking chain, wherein said device includes means to guide said first member and said second member into operative juxtaposition, and a motor to extend and collapse said rigid member.

* * * * *